US007909900B2

(12) United States Patent
Ras

(10) Patent No.: US 7,909,900 B2
(45) Date of Patent: Mar. 22, 2011

(54) METHOD OF MAKING A MODIFIED ABRASIVE COMPACT

(76) Inventor: Anine Hester Ras, Edenvale (ZA)

( * ) Notice: Subject to any disclaimer, the term of this patent is extended or adjusted under 35 U.S.C. 154(b) by 150 days.

(21) Appl. No.: 12/089,115

(22) PCT Filed: Oct. 12, 2006

(86) PCT No.: PCT/IB2006/002848

§ 371 (c)(1),
(2), (4) Date: Jul. 17, 2008

(87) PCT Pub. No.: WO2007/042920

PCT Pub. Date: Apr. 19, 2007

(65) Prior Publication Data

US 2009/0139150 A1 Jun. 4, 2009

(30) Foreign Application Priority Data

Oct. 14, 2005 (ZA) ..... 05/8347

(51) Int. Cl.
*B24D 18/00* (2006.01)
*B24D 3/10* (2006.01)

(52) U.S. Cl. ..... 51/309; 51/307

(58) Field of Classification Search ..... 51/307, 51/309

See application file for complete search history.

(56) References Cited

U.S. PATENT DOCUMENTS

| | | | |
|---|---|---|---|
| 4,224,380 | A | 9/1980 | Bovenkerk et al. |
| 5,728,227 | A | 3/1998 | Reverman |
| 6,544,308 | B2 | 4/2003 | Griffin et al. |
| 6,562,462 | B2 | 5/2003 | Griffin et al. |
| 2005/0139397 | A1 | 6/2005 | Achilles et al. |

FOREIGN PATENT DOCUMENTS

| | | |
|---|---|---|
| GB | 1 598 837 | 9/1981 |
| WO | WO 03/070852 A | 8/2003 |

*Primary Examiner* — Elizabeth D Wood
(74) *Attorney, Agent, or Firm* — Frommer Lawrence & Haug LLP; Ronald R. Santucci

(57) ABSTRACT

A method of treating the working surface of an abrasive compact having a working surface. The working surface, or a region adjacent the working surface, of the abrasive compact is contacted with a halogen gas or a gaseous environment containing a source of halide ions, preferably at a temperature at or below 800° C., in order to remove catalysing material and any foreign metal matrix material from the region adjacent the working surface.

19 Claims, 2 Drawing Sheets

METHOD OF MAKING A MODIFIED ABRASIVE COMPACT

This application is a 371 of PCT/IB2006/002848 filed on Oct. 12, 2006, published on Apr. 19, 2007 under publication number WO 2007/042920 A and claims priority benefits of South African Patent Application Number 2005/08347 filed Oct. 14, 2005, the disclosure of which is hereby incorporated by reference.

BACKGROUND OF THE INVENTION

This invention relates to a method of making modified abrasive compacts.

Cutting tool components utilising diamond compacts, also known as PCD, and cubic boron nitride compacts, also known as PCBN, are extensively used in drilling, milling, cutting and other such abrasive applications. The tool component will generally comprise a layer of PCD or PCBN bonded to a support, generally a cemented carbide support. The PCD or PCBN layer may present a sharp cutting edge or point or a cutting or abrasive surface.

Diamond abrasive compacts comprise a mass of diamond particles containing a substantial amount of direct diamond-to-diamond bonding. Polycrystalline diamond will typically have a second phase containing a diamond catalyst/solvent such as cobalt, nickel, iron or an alloy containing one or more such metals. cBN compacts will generally also contain a bonding phase which is typically a cBN catalyst or contain such a catalyst. Examples of suitable bonding phases for cBN are aluminium, alkali metals, cobalt, nickel, tungsten and the like.

In use, such a cutting tool insert is subjected to heavy loads and high temperatures at various stages of its life. In the early stages, when the sharp cutting edge of the insert contacts the subterranean formation or workpiece, the cutting tool is subjected to large contact pressures. This results in the possibility of a number of fracture processes such as fatigue cracking being initiated.

As the cutting edge of the insert wears, the contact pressure decreases and is generally too low to cause high energy failures. However, this pressure can still propagate cracks initiated under high contact pressures and can eventually result in spalling-type failures.

In optimising cutter performance increased wear resistance (in order to achieve better cutter life) is typically achieved by manipulating variables such as average abrasive grain size, overall catalyst/solvent content, abrasive density and the like. Typically, however, as a PCD or PCBN material is made more wear resistant it becomes more brittle or prone to fracture. PCD or PCBN elements designed for improved wear performance will therefore tend to have poor impact strength or reduced resistance to spalling. This trade-off between the properties of impact resistance and wear resistance makes designing optimised structures, particularly for demanding applications, inherently self-limiting.

If the chipping behaviours of more wear resistant PCD or PCBN can be eliminated or controlled, then the potentially improved performance of these types of cutters can be more fully realised.

It is known that removing all the metal infiltrant from a layer of PCD results in substantially improved resistance to thermal degradation at high temperatures, as disclosed in U.S. Pat. No. 4,224,380 and GB 1 598 837. JP 59219500 claims an improvement in the performance of PCD sintered materials after a chemical treatment of the working surface. This treatment dissolves and removes the catalyst/solvent matrix in an area immediately adjacent to the working surface. The invention is claimed to increase the thermal resistance of the PCD material in the region where the matrix has been removed without compromising the strength of the sintered diamond.

U.S. Pat. Nos. 6,544,308 and 6,562,462 describe the manufacture and behaviour of cutters that are said to have improved wear resistance without loss of impact strength. The PCD cutting element is characterised inter alia by a region adjacent the cutting surface which is substantially free of catalysing material. This partial removal (up to 70% of the diamond table being free of catalysing material) is said to be beneficial in terms of thermal stability.

Methods for the removal of the catalysing material that are mentioned in these patents are acid etching processes (for example, using hot hydrofluoric/nitric acid or hydrochloric/nitric acid mixtures), or electrical discharge or other electrical or galvanic processes, or thermal evaporation. These methods, however, do not take into account the variation in the composition of the metal matrix. Sintering of abrasive compacts is carried out in high temperature-high pressure presses that have a degree of variability in the pressure and temperature conditions that they produce. This variability is exacerbated by the difficulty of monitoring the high pressures and high temperatures required for synthesis and sintering.

The process variability is caused by gradual ageing of press components with use, by variations in the physical dimensions and properties of the capsule components, and by pressure and temperature gradients within the capsule. These gradients can be minimised by careful choice of the materials of construction of the capsule components and by the overall design of the capsule. Furthermore, the pressure-temperature-time operating conditions for the press can be developed to minimise such gradients. However, the gradients can never be totally removed.

A much larger and unavoidable source of variability is the different process conditions required to sinter different PCD or PCBN products, which by design have different grain sizes, different layer thicknesses, different layer compositions and different overall heights and outer diameters.

All of the abovementioned sources of variability result in differences in the final composition of the metal matrix. The variability in the composition of the metal matrix results in variable rates of removal of the metal matrix, as certain components of the metal matrix will be more susceptible to the method of removal, and some will be less susceptible. Where the source of variability in the metal matrix composition is within a capsule, this results in variations in thickness of the thermally stable layer within an abrasive compact, and this is unacceptable, as it translates into areas of better and poorer performance on an abrasive compact.

Where the source of variability is the press or the press conditions, in other words external to the capsule, it necessitates the continual adjustment of the conditions under which the catalysing material is removed according to the specific abrasive compact product. From a production point of view, this is inconvenient and potentially more costly.

SUMMARY OF THE INVENTION

A method of treating an abrasive compact having a working surface, the method comprising contacting the working surface, or a region adjacent the working surface, of the abrasive compact with a halogen gas or a gaseous environment containing a source of halide ions, preferably at a temperature at or below 800° C., in order to remove catalysing material and any foreign metal matrix material from the region adjacent the working surface.

The contacting of the working surface or adjacent region preferably takes place at a temperature of from about 300° C. to about 800° C., more preferably from about 650° C. to about 700° C.

The abrasive compact preferably comprises PCD or PCBN.

The metal matrix of the abrasive compact typically comprises a catalyst/solvent such as Ni, Co, or Fe, foreign metal matrix material, such as metals or metal compounds selected from the group comprising compounds, such as carbides, of titanium, vanadium, niobium, tantalum, chromium, molybdenum, and tungsten, and optionally a second or binder phase.

The PCD or PCBN abrasive compact is preferably produced in accordance with an HPHT process.

The halogen gas or gaseous environment preferably comprises chlorine, hydrogen chloride, hydrogen fluoride, carbon monoxide, hydrogen and fluorine.

According to a further aspect of the invention, there is provided an abrasive compact, comprising a layer of abrasive material containing catalysing material, foreign metal matrix material, and optionally a second or binder phase, having a working surface and bonded to a substrate, particularly a cemented carbide substrate, along an interface, the abrasive compact being characterised by the abrasive layer having a region adjacent the working surface lean in catalysing material and foreign metal matrix material, which in particular is uniform, and a region rich in catalysing material and foreign metal matrix material.

DETAILED DESCRIPTION OF PREFERRED EMBODIMENTS

Figure 1:
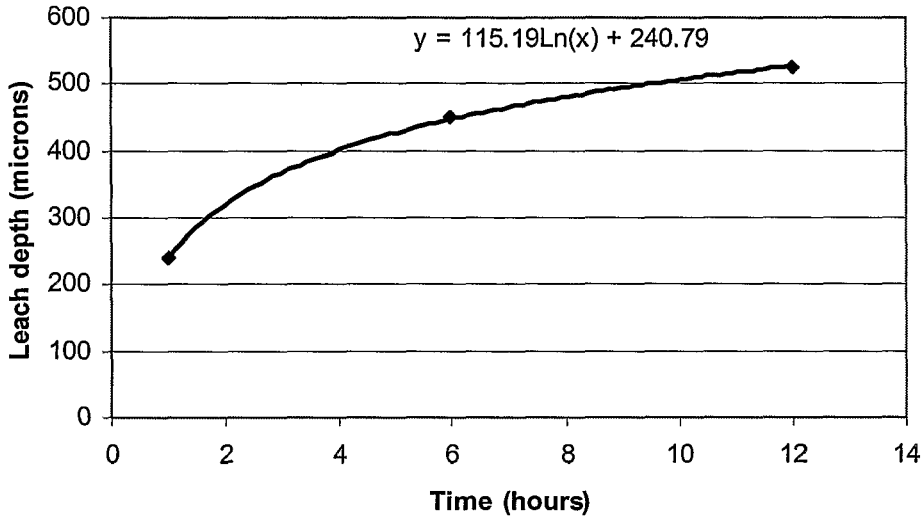
FIG. 1 is a graph showing the depletion depth of metal matrix material from the polycrystalline diamond layer of a polycrystalline diamond abrasive compact that was exposed to dry hydrogen chloride and chlorine gas mixture for an extended time.

The crux of the invention is the removal of metal matrix material, typically comprising foreign metal matrix material in addition to catalysing material, from an abrasive compact in such a way that a substantially uniform layer or region lean in the metal matrix or catalyst material is produced.

The invention is, therefore, particularly directed at a method of removing the metal matrix from PCD or PCBN such that it results in a uniform treated layer thickness. As the metal matrix of a typical abrasive compact consists of one or more corrosion resistant metals (such as tungsten) and one or more metals susceptible to corrosion (such as cobalt) in varying amounts, the method must be capable of removing all these metals at a similar rate in order to form a treated layer of uniform thickness.

For convenience, an abrasive compact having a metal matrix material including tungsten and cobalt will be used to illustrate the invention. It is well known that tungsten reacts with halogens to give tungsten halide species. The possibility of developing a two-step process by which cobalt is first removed by hydrochloric acid, followed by the removal of tungsten by high temperature reaction with a halogen source, was considered in order to address the problem of layer thickness variability. It was believed that a two-step process would be necessary because cobalt halides often need high temperatures to volatilise, and these high temperatures would be detrimental to the strength and wear behaviour of the abrasive compact. For example, cobaltous chloride, $CoCl_2$, melts at 724° C. and boils at 1049° C. In the case of a polycrystalline diamond abrasive compact, the maximum temperature it may be exposed to without damage is approximately 800° C., and then only in an inert atmosphere or vacuum, and for a short period of time. Any process for the removal of the metal matrix would have to be carried out at considerably below 800° C., and so the treatment of abrasive compacts with a halogen source would almost certainly result in the formation of solid or molten species of cobalt halides, which would passivate or mask the metal surface and slow down or halt the metal removal process.

With the above in mind, treating PCD with chlorine gas, and chlorine gas containing carbon monoxide, in an argon gas mix was tested at 600° C., 650° C. and 700° C. The surprising result was that both cobalt and tungsten were removed, although some tungsten remained behind. XRF analysis showed that the remaining tungsten was associated with oxygen. Further trials were carried out at 400° C., 500° C., 600° C. and 700° C. with chlorine gas in an argon atmosphere, but this time with hydrochloric acid gas as a source of hydrogen, with the intention of volatilising any tungsten oxide species as tungsten oxychlorides. A mix of hydrogen and chlorine gas may also be used, but the gas composition needs to be very carefully controlled in order to avoid the possibility of explosion.

The method must also be capable of volatilising other metals or metal compounds that may be present. These metals or metal compounds may be present due to solid-state or liquid-state diffusion into the PCD or PCBN layer from the capsule components in contact with the layer during HPHT sintering. Examples are the carbides of metals such as titanium, vanadium, niobium, tantalum, chromium, molybdenum and tungsten, or the metals themselves.

Some metal compounds present may form passivated areas or layers, and the method must be capable of removing these too. Examples of such compounds are oxides or carbides of tungsten, cobalt or the capsule component materials of construction. An example of how the method deals with tungsten oxides is to add a source of hydrogen, such as hydrogen chloride gas, which reacts with tungsten oxides to form volatile tungsten oxychlorides.

It has been found that by treating an abrasive compact at temperatures of 300° C.-800° C., preferably 650° C.-700° C., in a gaseous environment containing 0.1%-100% chlorine, and preferably 10%-20% chlorine, with the balance being argon gas, a substantially uniform region or layer of the material that is substantially free of metal matrix material can be produced.

Optionally, a source of hydrogen, for example hydrogen chloride gas, or a reducing gas, for example carbon monoxide, in amounts of 0.1%-99.9%, and preferably 10%-20%, can be used to enhance the removal of the metal matrix, for example by removing any tungsten oxide still present in the layer or region. Another possibility is an ammonium halide salt, which in the case of ammonium chloride decomposes at temperature to form nitrogen gas, hydrogen gas and chlorine gas. The latter two may react at temperature to form hydrogen chloride gas in situ. In the case of hydrogen gas, care must be taken to avoid explosive mixtures with chlorine gas. An example of a non-explosive mixture range would be 0-3.5% chlorine and 0-2% hydrogen, with the remainder being an inert gas such as argon.

In carrying out the method of the invention, the PCD or PCBN abrasive compacts are first subjected to a masking treatment to mask any areas that must remain unaffected. An example of a masking treatment is electrodeposition of Inconel on the cemented tungsten carbide and/or PCD or PCBN surface, where appropriate.

The abrasive compacts are placed in a quartz tube in a box furnace. The tube is flushed with argon at room temperature, then sealed off from the atmosphere and the temperature increased at a rate of e.g. 10° C./min under a flow of argon, until the required temperature is reached.

At temperature, the reaction gases are turned on, and a flowrate of, for example, 900 ml/min (at 25° C. and 1 atmosphere) is maintained for the duration of the reaction, which is typically 1 hour, but may be anything from 15 minutes to 12 hours or more, depending on the gas composition, the temperature and the required depth of removal of the metal matrix material.

At completion, the reaction gases are turned off and the furnace cooled slowly under argon.

The masking agent may be removed by grinding or any other suitable method. If a suitable masking agent is chosen, it may be unnecessary to remove it prior to application of the abrasive compact.

Although particular emphasis has been placed on chlorine gases or gaseous environments containing chlorine ions, for convenience, other halogen gases and halide ions are encompassed by the present invention.

Besides dealing with the problem of variability of the thermally stable layer, the present invention is quicker (than for example electrical or galvanic processes), generates less effluent (than for example an acid etching process), and in some instances is less hazardous (than for example a hydrofluoric/nitric acid process).

The invention will now be discussed in more detail, by way of example only, with reference to the following non-limiting examples.

Example 1

Using Chlorine Gas

A polycrystalline diamond abrasive compact with a Co—WC backing was placed in a quartz tube inside a box furnace, and the tube was flushed with argon gas. The temperature was increased to 700° C. at a rate of 10° C./minute. When the final temperature was reached, a gas mixture consisting of 80% argon and 20% chlorine was introduced into the tube at a rate of 900 ml/minute for 1 hour. The gas was then turned off and the furnace was cooled under argon gas. The abrasive compact was removed from the tube, cut and polished in order to expose a cross section of the polycrystalline diamond layer, and the depth of removal of the metal matrix material from the polycrystalline diamond layer was measured using a scanning electron microscope.

The procedure was repeated for two more abrasive compacts, with the final temperature set at 650° C. and 600° C. respectively.

Results showed a barely discernible layer depleted of metal matrix after 1 hour at 600° C., a clearly visible depleted layer after 1 hour at 650° C., and a thick depleted layer after 1 hour at 700° C. The average thickness of the depleted layer after 1 hour at 700° C. was 246 μm, with a standard deviation of 64 μm across the abrasive compact. The Cobalt:Tungsten:Oxygen ratio changed from 54:18:29 before gas treatment, to 24:28:49 after gas treatment, indicating that the cobalt was removed preferentially to the tungsten, and that oxygen remained in the compact.

Example 2

Using Carbon Monoxide/Chlorine Gas Mixture

The same procedure was followed as for Example 1, except that the gas mixture introduced into the tube at temperature consisted of 20% carbon monoxide, 20% chlorine and 60% argon. After 1 hour at 600° C., the depleted layer was barely discernible, but at 650° C. it was again clearly visible. At 700° C. for 1 hour, the average thickness of the depleted layer was 314 μm, with a standard deviation of 33 μm across the compact. The Cobalt:Tungsten:Oxygen ratio changed from 58:18:24 before gas treatment, to 22:37:41 after gas treatment, indicating that the cobalt was again removed preferentially to the tungsten, and that oxygen remained in the compact.

Example 3

Using Chlorine/Hydrogen Chloride Gas Mixture

The same procedure was followed as for Example 1, except that the gas mixture introduced into the tube at temperature consisted of 20% chlorine, 20% hydrogen chloride and 60% argon. In this case, the hydrogen chloride gas was generated by bubbling argon through a concentrated solution of hydrochloric acid. As a result, some water vapour was also carried over into the tube. At 700° C. for 1 hour, the average thickness of the depleted layer was 133 μm, with a standard deviation of 10 μm across the compact, indicating a greatly improved variability. The Cobalt:Tungsten:Oxygen ratio changed from 59:28:14 before gas treatment, to 22:52:26 after gas treatment, indicating that the cobalt was again removed preferentially to the tungsten, and that oxygen remained in the compact.

Example 4

Using Dry Hydrochloric Acid and Chlorine Gas Mixture

The same procedure was followed as for Example 1, except that the gas mixture introduced into the tube at temperature consisted of 20% chlorine, 20% hydrogen chloride and 60% argon. In this case, the hydrogen chloride gas was obtained from a cylinder of dry hydrogen chloride gas. At 700° C. for 1 hour, the average thickness of the depleted layer was 663 μm, with a standard deviation of 8 μm across the compact, indicating a greatly improved variability as well as rate of removal. The Cobalt:Tungsten:Oxygen ratio changed from 53:35:12 before gas treatment, to 20:27:53 after gas treatment, indicating that the cobalt and tungsten were both removed.

Example 5

Using Dry Hydrogen Chloride and Chlorine Gas Mixture for Extended Time

The same procedure was followed as for Example 4, except that in this case the abrasive compact had no Co—WC backing. The gas treatment was carried out for 1 hour, 6 hours and 12 hours. The results are shown in the graph in accompanying FIG. 1. The decrease in depletion depth over time is ascribed to diffusion rate control in the abrasive compact. A double depletion layer was observed in the abrasive compacts, which was ascribed to slightly different removal rates for cobalt and tungsten. It is believed that by adjusting the ratio of chlorine and hydrogen chloride in the gas mixture, these removal rates may be made equal, so that no double depletion layer would form.

Comparative Examples

The following comparative examples are provided to illustrate the degree of variability that may be experienced within a compact using a conventional acid leaching process. Ten PCD sintered abrasive compacts were subjected to conventional acid leaching in boiling 16% hydrochloric acid for a period of time. Afterwards, they were cut to reveal a cross-section of the layer from which the metal matrix had been removed, and the thickness of the layer at each side wall, as well as at the left, centre and right side, was measured using a scanning electron microscope.

Figure 2:
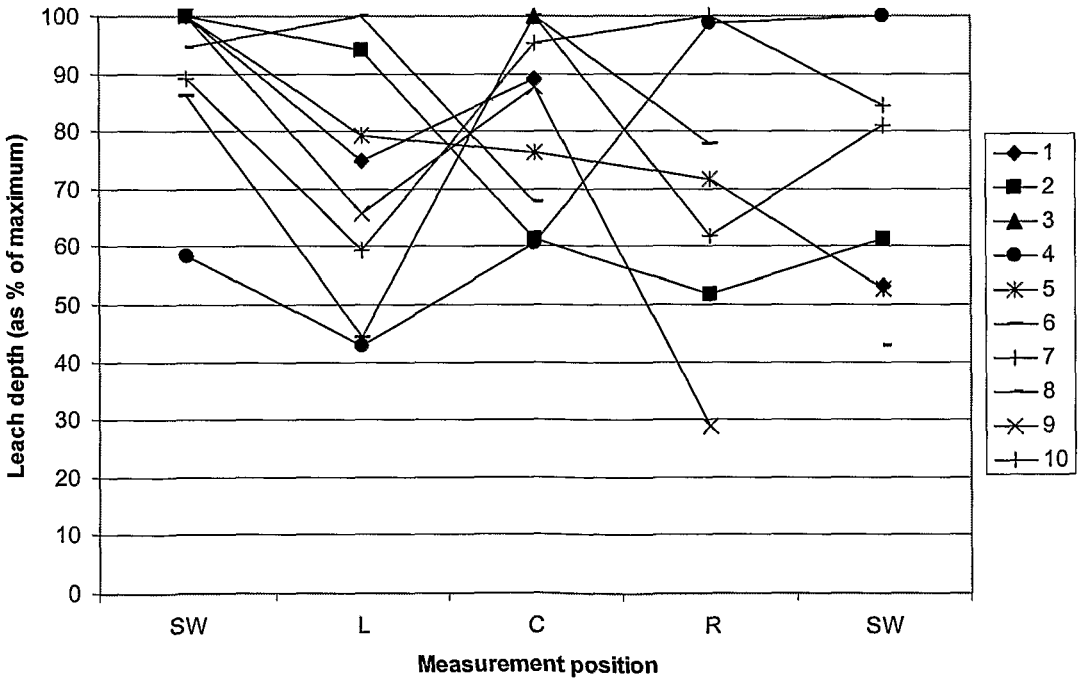
FIG. 2 is a graph showing a comparison of depletion depth of metal matrix material at different measurement positions of ten PCD sintered abrasive compacts that were subjected to conventional acid leaching in boiling 16% hydrochloric acid for a period of time. The measurement positions were side-wall (SW), left (L), centre (C), and right (R).

The results of these measurements are shown graphically in the accompanying FIG. 2, where the measurement positions are indicated as SW(side-wall)-L(left)-C(centre)-R (right)-SW(side-wall).

For ease of comparison, the leach depth at each measurement point is expressed in relative terms as a % of the maximum leach depth measured for sample. Hence in sample 1, the centre measurement is indicated as 89% of the maximum measured leach depth for sample 1, which was measured at the left sidewall position. It is clear that there is a distinct lack of uniformity in leach depth in these abrasive compacts.

Figure 3:
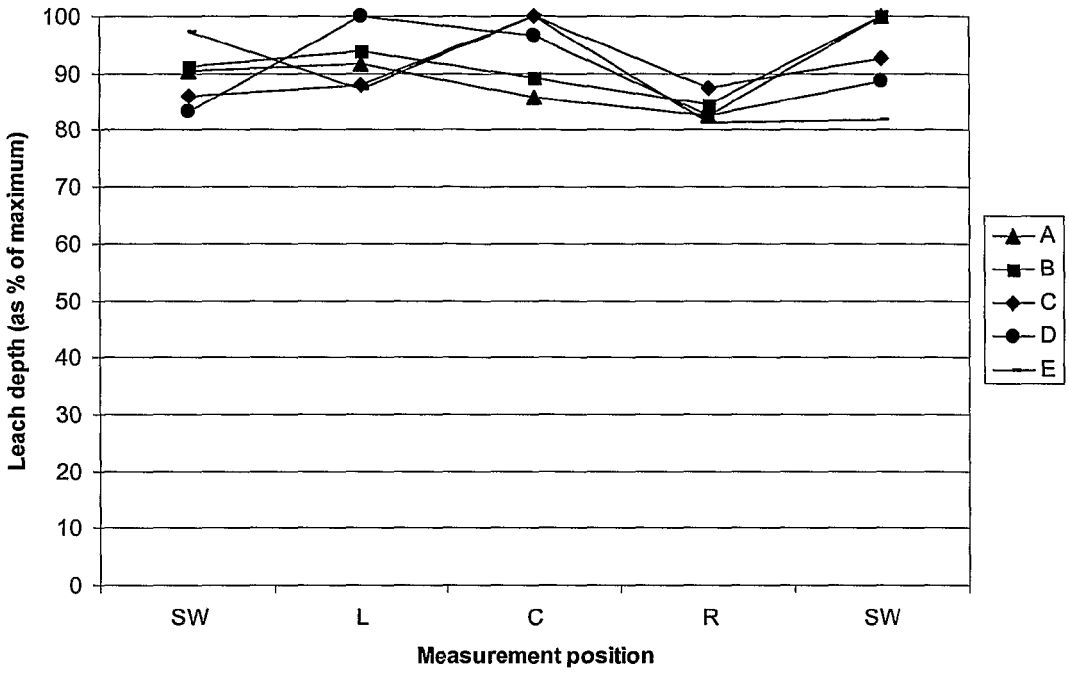
FIG. 3 is a graph showing a comparison of depletion depth of metal matrix at different measurement positions of cutters (A, B, C, D, and E) that were leached due to exposure to a chloride/hydrogen chloride gas mixture. The measurement positions were side-wall (SW), left (L), centre (C), and right (R).

A method of this invention, as described in example 3 (above), was then used to leach several cutters, designated as cutters A, B, C, D and E. The results of these treatments are shown in accompanying FIG. 3, where it is clear that there is a significant improvement in the uniformity of leach depth in these abrasive compacts.

The invention claimed is:

1. A method of treating an abrasive compact having a working surface, the method comprising contacting the working surface, or a region adjacent the working surface, of the abrasive compact with a halogen gas or a gaseous environment containing a source of halide ions in order to remove catalysing material and any foreign metal matrix material from the region adjacent the working surface.

2. A method according to claim 1, wherein contacting of the working surface or adjacent region takes place at a temperature at or below 800° C.

3. A method according to claim 1, wherein contacting of the working surface or adjacent region takes place at a temperature of from about 300° C. to about 800° C.

4. A method according to claim 3, wherein contacting of the working surface or adjacent region takes place at a temperature of from about 650° C. to about 700° C.

5. A method according to claim 1, wherein the abrasive compact comprises PCD or PCBN.

6. A method according to claim 5, wherein the abrasive compact comprises a layer of PCD or PCBN bonded to a metal matrix, the metal matrix comprising a catalyst/solvent, foreign metal matrix material, and optionally a second or binder phase.

7. A method according to claim 5, wherein the PCD or PCBN abrasive compact is produced in accordance with an HPHT process.

8. A method according claim 1, wherein the halogen gas or gaseous environment comprises a gas or gases selected from the group comprising consisting of chlorine, hydrogen chloride, hydrogen fluoride, carbon monoxide, hydrogen and fluorine.

9. A method according to claim 1, wherein the halogen gas or gaseous environment includes a source of hydrogen.

10. A method according to claim 9, wherein the halogen gas or gaseous environment comprises a mixture of chlorine gas and hydrochloric acid gas or a mixture of chlorine gas and hydrogen gas.

11. A method according to claim 9, wherein the halogen gas or gaseous environment is provided by decomposition of an ammonium halide salt.

12. A method according to claim 1, wherein the gaseous environment comprises a mixture of gas or gases selected from the group consisting of chlorine, hydrogen chloride, hydrogen fluoride, fluorine, and carbon monoxide.

13. A method according to claim 2, wherein the gaseous environment comprises a mixture of gas or gases selected from the group consisting of chlorine, hydrogen chloride, hydrogen fluoride, fluorine, and carbon monoxide.

14. A method according to claim 3, wherein the gaseous environment comprises a mixture of gas or gases selected from the group consisting of chlorine, hydrogen chloride, hydrogen fluoride, fluorine, and carbon monoxide.

15. A method according to claim 4, wherein the gaseous environment comprises a mixture of gas or gases selected from the group consisting of chlorine, hydrogen chloride, hydrogen fluoride, fluorine, and carbon monoxide.

16. A method according to claim 5, wherein the gaseous environment comprises a mixture of gas or gases selected from the group consisting of chlorine, hydrogen chloride, hydrogen fluoride, fluorine, and carbon monoxide.

17. A method according to claim 6, wherein the gaseous environment comprises a mixture of gas or gases selected from the group consisting of chlorine, hydrogen chloride, hydrogen fluoride, fluorine, and carbon monoxide.

18. A method according to claim 7, wherein the gaseous environment comprises a mixture of gas or gases selected from the group consisting of chlorine, hydrogen chloride, hydrogen fluoride, fluorine, and carbon monoxide.

19. A method according to claim 8, wherein the gaseous environment comprises a mixture of gas or gases selected from the group consisting of chlorine, hydrogen chloride, hydrogen fluoride, fluorine, and carbon monoxide.

* * * * *